US010637191B2

(12) United States Patent
Nagase et al.

(10) Patent No.: US 10,637,191 B2
(45) Date of Patent: Apr. 28, 2020

(54) CONNECTOR AND CONNECTOR ASSEMBLY

(71) Applicant: Molex, LLC, Lisle, IL (US)

(72) Inventors: Rie Nagase, Yamato (JP); Nobumasa Motohashi, Yamato (JP); Manabu Yamanaka, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/193,121

(22) Filed: Nov. 16, 2018

(65) Prior Publication Data

US 2019/0157804 A1 May 23, 2019

Related U.S. Application Data

(60) Provisional application No. 62/587,585, filed on Nov. 17, 2017.

(30) Foreign Application Priority Data

Feb. 26, 2018 (JP) ..... 2018-031921

(51) Int. Cl.

| | |
|---|---|
| ***H01R 13/62*** | (2006.01) |
| ***H01R 13/627*** | (2006.01) |
| *H01R 12/72* | (2011.01) |
| *H01R 13/6583* | (2011.01) |

(52) U.S. Cl.

CPC ..... *H01R 13/6272* (2013.01); *H01R 13/6275* (2013.01); *H01R 12/724* (2013.01); *H01R 13/6583* (2013.01)

(58) Field of Classification Search

CPC ..... H01R 13/6272
USPC ..... 439/358
See application file for complete search history.

(56) References Cited

U.S. PATENT DOCUMENTS

| | | | | |
|---|---|---|---|---|
| 6,585,536 | B1 * | 7/2003 | Wu | H01R 13/6275 439/358 |
| 7,581,978 | B1 * | 9/2009 | Briant | H01R 13/6275 439/358 |
| 7,682,182 | B2 | 3/2010 | Kondo et al. | |
| 7,841,889 | B2 * | 11/2010 | Gerard | H01R 13/6272 439/358 |
| 2008/0318462 | A1 | 12/2008 | Gerard et al. | |
| 2019/0157804 | A1 * | 5/2019 | Nagase | H01R 13/6272 |

FOREIGN PATENT DOCUMENTS

| | | | |
|---|---|---|---|
| CN | 2593389 | Y | 12/2003 |
| CN | 201252250 | Y | 6/2009 |
| CN | 101645565 | A | 2/2010 |
| CN | 101924296 | A | 12/2010 |

(Continued)

*Primary Examiner* — Neil Abrams
(74) *Attorney, Agent, or Firm* — Molex, LLC

(57) ABSTRACT

A connector includes a housing, a terminal installed in the housing, and a latch member. The housing has a top plate part including a spring part that has a cantilever form and is formed by cutting off a part of the top plate part. The latch member includes a main body part, an engagement part connected to a front end of the main body part, and an operation part that is connected to a back end of the main body part and is capable of coming into contact with a free end portion of the spring part, and the latch member is attached to the top plate part to be capable of swinging.

23 Claims, 17 Drawing Sheets

(56) References Cited

FOREIGN PATENT DOCUMENTS

| | | | |
|---|---|---|---|
| CN | 103891058 | A | 6/2014 |
| CN | 203911116 | U | 10/2014 |
| CN | 106252983 | A | 12/2016 |
| CN | 106463883 | A | 2/2017 |
| CN | 205944600 | U | 2/2017 |
| CN | 106972333 | A | 7/2017 |
| JP | 2009-026667 | A | 2/2009 |

* cited by examiner

CONNECTOR AND CONNECTOR ASSEMBLY

RELATED APPLICATIONS

This application claims priority to U.S. Application No. 62/587,585, filed Nov. 17, 2017, and to Japanese Application No. 2018-031921, filed Feb. 26, 2018, both of which are incorporated herein by reference in their entirety.

TECHNICAL FIELD

The present disclosure relates to a connector and a connector assembly.

BACKGROUND ART

Conventionally, miniature and low profile connectors have been widely used for connecting a wire such as a cable to substrates such as printed circuit boards contained in electrical equipment, electronic equipment, etc. One problem concerning such connectors is that these connectors easily come off or release connected mating connectors. Therefore, a latch connector including a latch mechanism has been proposed (see, for example, Patent Document 1).

FIG. 17 is a view illustrating a conventional latch connector.

In the figure, 811 is a mating part of a housing of a latch connector connected to the tip of a cable 861. The mating part is a portion mating with a mating connector (not illustrated). The housing including the mating part 811 is made of an insulating resin material. The mating part 811 has a rectangular opening in which a multiple terminals 851 to be electrically connected to mating terminals (not illustrated) are provided. The mating part 811 is surrounded by a shell 871 that is made of a metal plate and has a rectangular tube shape.

The housing has a main body part, provided more on the back side than the mating part 811, covered with a cover member 821 made of an insulating resin material. The main body part of the housing has a back end connected with the cable 861. Multiple wires contained in the cable 861 are soldered to the multiple terminals 851.

Moreover, a pair of right and left notched parts 873 are formed on the top plate of the shell 871, with a latch member housed inside each notched part 873. The latch member is a cantilevered elastic member made of a long narrow metal plate stretching in the anteroposterior direction, with a latch claw 881 protruding upward formed on the tip thereof, that is, on the free end thereof, and the base end thereof fixed in the housing.

A latch release button 826 is provided at the center of the top plate of the cover member 821. The latch release button 826 is disposed between the tip and the base end of a pair of right and left latch members, and just above the portion adjacent to the base end.

Because the latch member has spring properties and is always flush with the top plate of the shell 871, the latch claw 881 constantly protrudes above the top plate of the shell 871. Therefore, for the case in which the latch connector and a mating connector are mated together, when the mating part 811 is inserted into the insertion opening of the mating connector (not illustrated), the latch claw 881 enters a locking hole formed on the top plate of the insertion opening of the mating connector so as to be locked. As a result, the mating part 811 of the latch connector is latched by the insertion opening of the mating connector and prevented from being separated from the insertion opening.

Moreover, for the case in which the mating between the latch connector and the mating connector is released to remove the latch connector, an operator presses down the latch release button 826 protruding above the top plate of the cover member 821 by finger. Thereupon, the latch release button 826 presses down the portion adjacent to the base end of the pair of right and left latch members, causing the latch claw 881 at the tip of the latch member to be displaced downward and come off the locking hole formed on the top plate of the insertion opening of the mating connector. As a result, the locking state between the latch claw 881 and the locking hole is released and the latch between the mating part 811 of the latch connector and the insertion opening of the mating connector is released, allowing the mating part 811 to come off the insertion opening of the mating connector.

Patent Document 1: Japanese Unexamined Patent Publication No. 2009-026667

SUMMARY

Unfortunately, because in conventional latch connectors, the long narrow plate latch member is provided on each of the right and left of a top plate of the shell 871, the strength of each latch member and the latch claw 881 formed at the free end of the latch member is low. Therefore, for example, for the case in which an operator, etc. mistakenly has his/her foot caught in the cable 861 with the latch connector mating with a mating connector, thereby adding great tensile force to the latch connector, the latch member or the latch claw 881 is deformed to release the latch and release the mating between the latch connector and the mating connector.

In order to prevent such a situation, the dimensions (plate thickness, width, etc.) of the latch member and the latch claw 881 must be increased to improve the strength of the latch member and the latch claw 881; however, under the recent environment of the ongoing miniaturization of electrical equipment, electronic equipment, etc., increasing the dimensions of the latch member and the latch claw 881, which leads to the enlargement of the latch connector, is difficult.

Here, in order to resolve the conventional problem, an object is to provide a connector and a connector assembly that can increase latching strength with a simple structure and without enlarging the dimensions such that even when unexpected external force is added, the latch is not released and the mating state with the mating connector can be assuredly maintained.

To achieve this object, a connector includes a housing, a terminal installed in the housing, and a latch member. The housing has a top plate part including a spring part that has a cantilever form and is formed by cutting off a part of the top plate part. The latch member includes a main body part, an engagement part connected to a front end of the main body part, and an operation part that is connected to a back end of the main body part and is capable of coming into contact with a free end portion of the spring part, and the latch member is attached to the top plate part to be capable of swinging.

In another connector, the main body part of the latch member includes a fulcrum part serving as a fulcrum of the swinging, and held parts formed in vicinity of the fulcrum part, and the held parts are each held by a corresponding one of holding parts formed on the top plate part.

In yet another connector, each of the holding parts has both ends connected to the top plate part to be an arch shaped member, and include a holding opening formed by the holding part and an upper surface of the top plate part, and each of the held parts is loose fit in a corresponding one of the holding openings to be held.

In still another connector, the main body part of the latch member includes notched holes each stretched in an antero-posterior direction and having a substantially rectangular shape, each of the held parts is integrally connected to the main body part at a back edge of a corresponding one of the notched holes, and is stretched forward from the back edge, each of the notched holes includes a restriction part stretched backward from a front edge of the notched hole, and a gap is provided between a tip of the restriction part and a tip of the held part.

In still another connector, the main body part of the latch member has a lower surface that is substantially flush with an upper surface of the top plate part, and the operation part is positioned above the upper surface of the top plate part.

In still another connector, a pair of right and left held parts are formed on the main body part of the latch member, a pair of right and left holding parts holding the held parts are formed on the top plate part, and the spring part is a plate spring stretched backward from a base end connected to the top plate part, and formed between the pair of right and left holding parts.

In still another connector, an upper surface of a main body part of the spring part is substantially flush with an upper surface of the top plate part, and the spring part has a free end part that protrudes upward beyond the upper surface of the top plate part.

A connector assembly includes the connector according to the present disclosure, and a mating connector that includes a mating engagement part capable of engaging with the engagement part of the latch member, the mating connector being capable of mating with the connector.

In another connector assembly, a terminal of a cable is connected to any one of the connector and the mating connector.

According to the present disclosure, latching strength can be increased with a simple structure and without enlarging the dimensions such that even when unexpected external force is added, the latch is not released. Thus, the mating state with the mating connector can be assuredly maintained.

BRIEF DESCRIPTION OF THE DRAWINGS

FIG. 6A is a perspective view as viewed from an upper side and FIG. 6B is a perspective view as viewed from a lower side.

FIG. 9A is an arrow cross section along the A-A line in FIG. 8, and FIG. 9B is an arrow cross section along the B-B line in FIG. 8.

FIG. 10A is an enlarged view of a portion D in FIG. 9A, and FIG. 10B is an enlarged view of a portion E in FIG. 9B.

DETAILED DESCRIPTION OF THE PREFERRED EMBODIMENTS

Embodiments will be described in detail below with reference to drawings.

Figure 1:
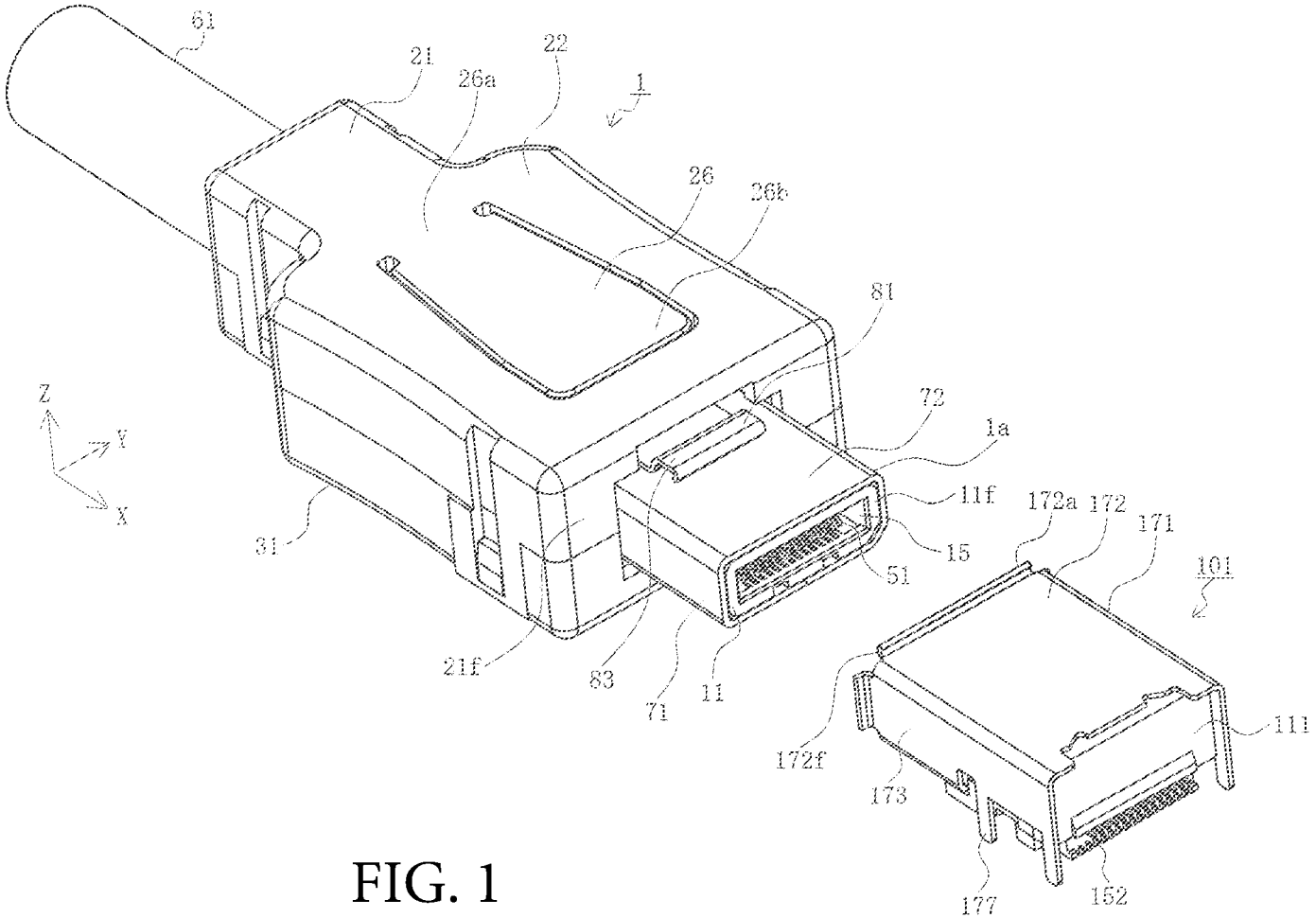
FIG. 1 is a perspective view illustrating a state prior to mating a wire connector and a substrate connector according to an embodiment.
Figure 2:
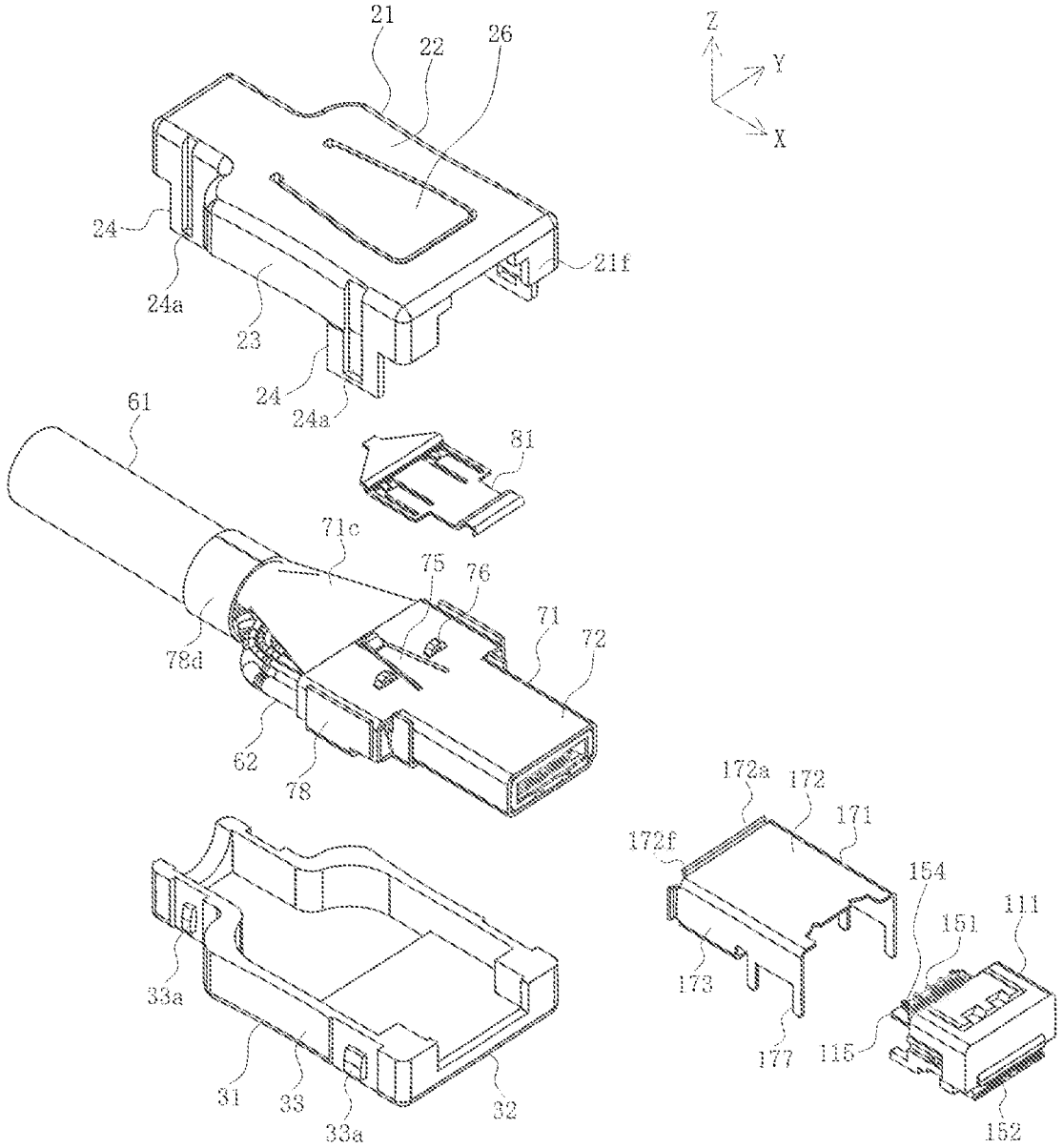
FIG. 2 is an exploded view of the wire connector and the substrate connector according to the embodiment.
Figure 3:
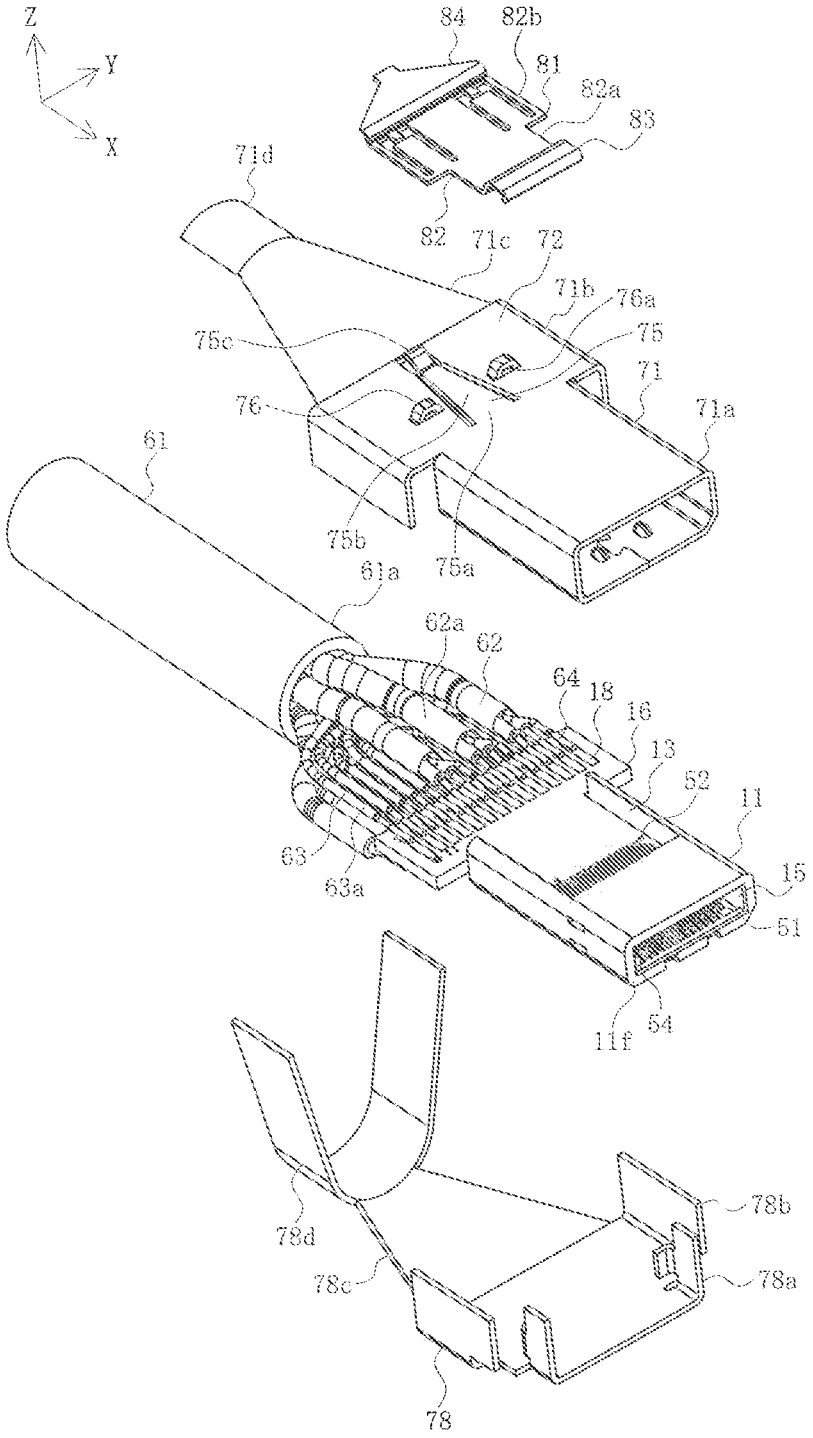
FIG. 3 is an exploded view of a portion of the wire connector according to the embodiment, excluding a cover housing.
Figure 4:
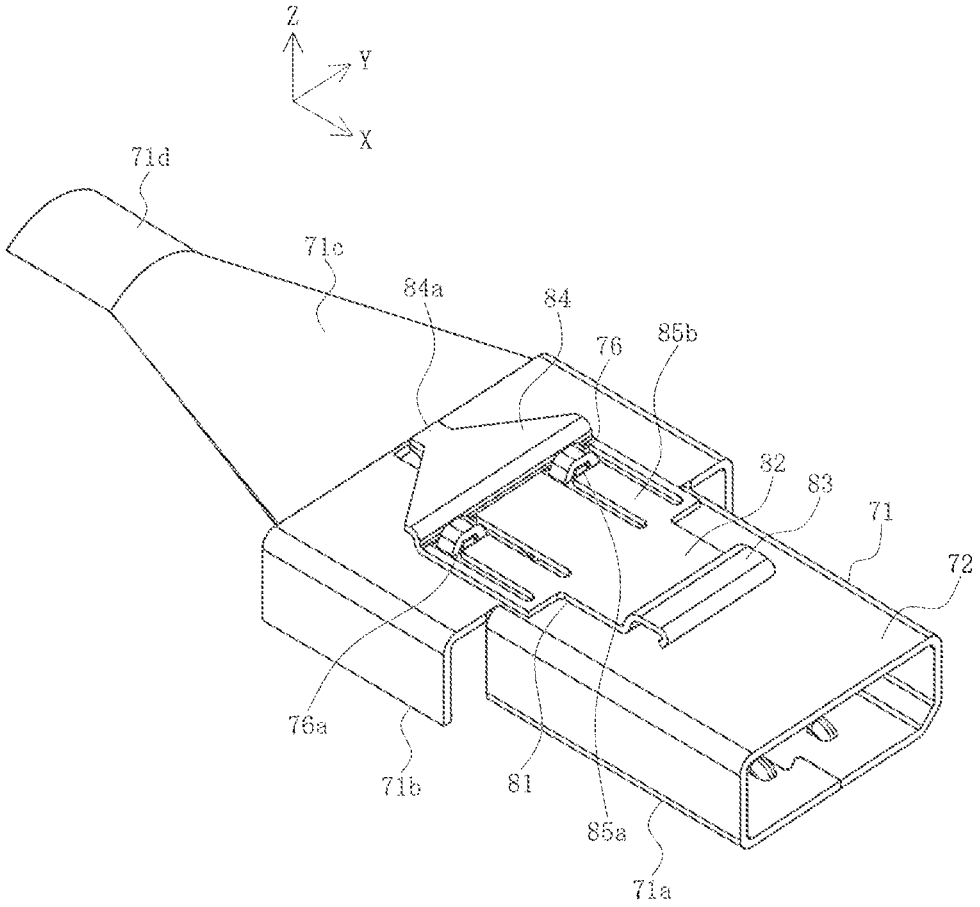
FIG. 4 is a perspective view of a part of the wire connector according to the embodiment as viewed from the above.
Figure 5:
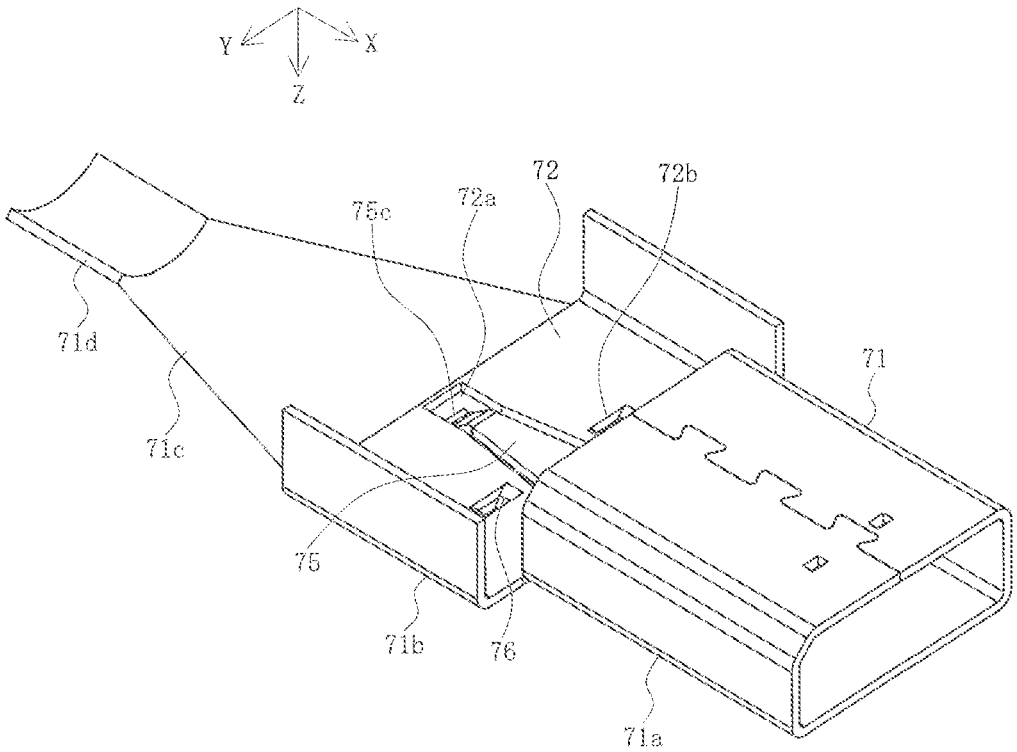
FIG. 5 is a perspective view of a part of the wire connector according to the embodiment as viewed from a lower side.
Figure 6A:
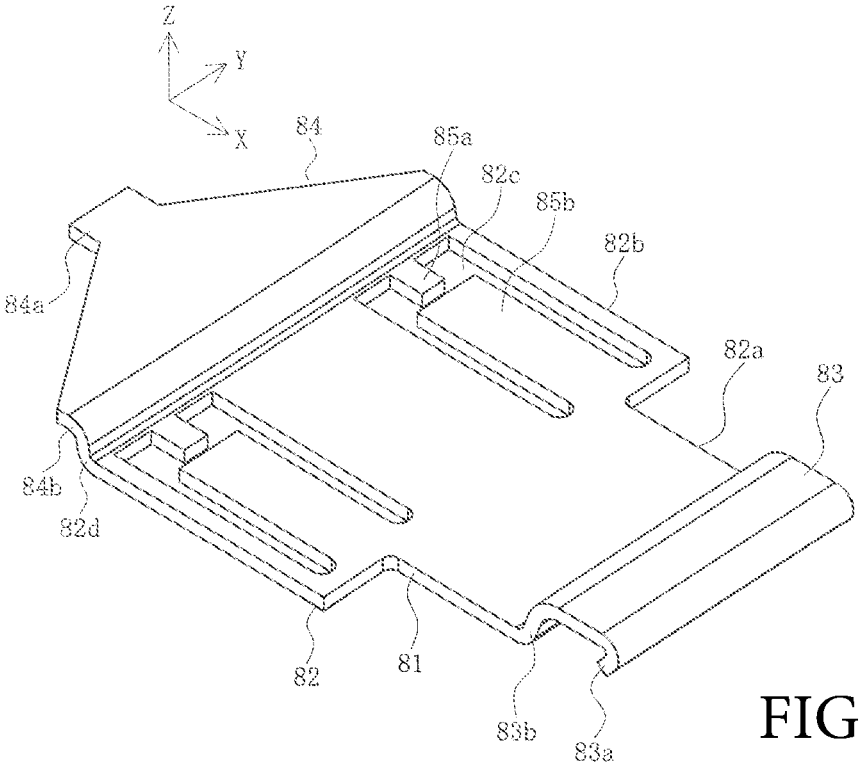
FIGS. 6A and 6B are perspective views of a latch member of the wire connector according to the embodiment, where
Figure 6B:
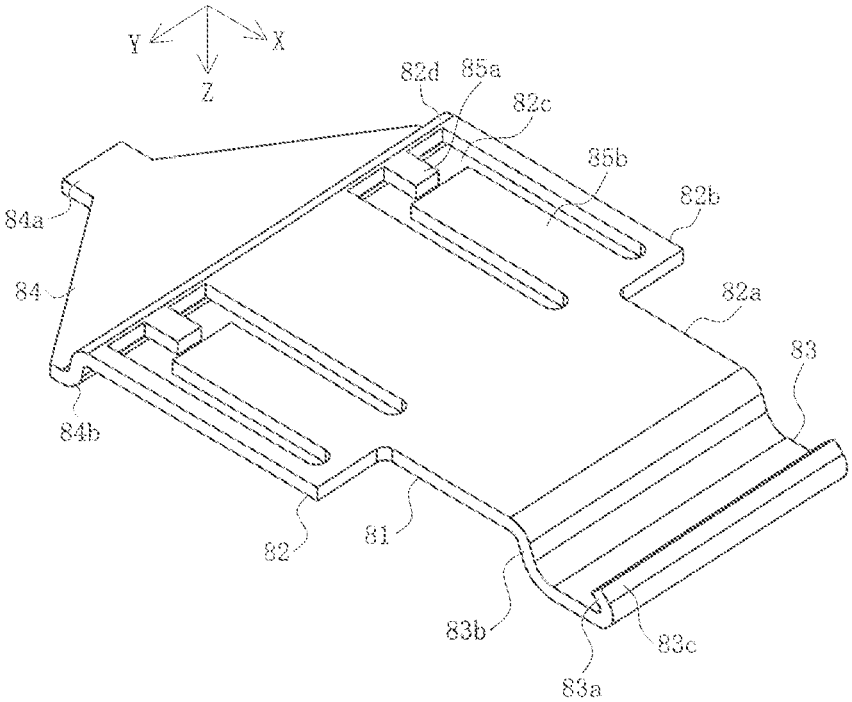
Figure 7:
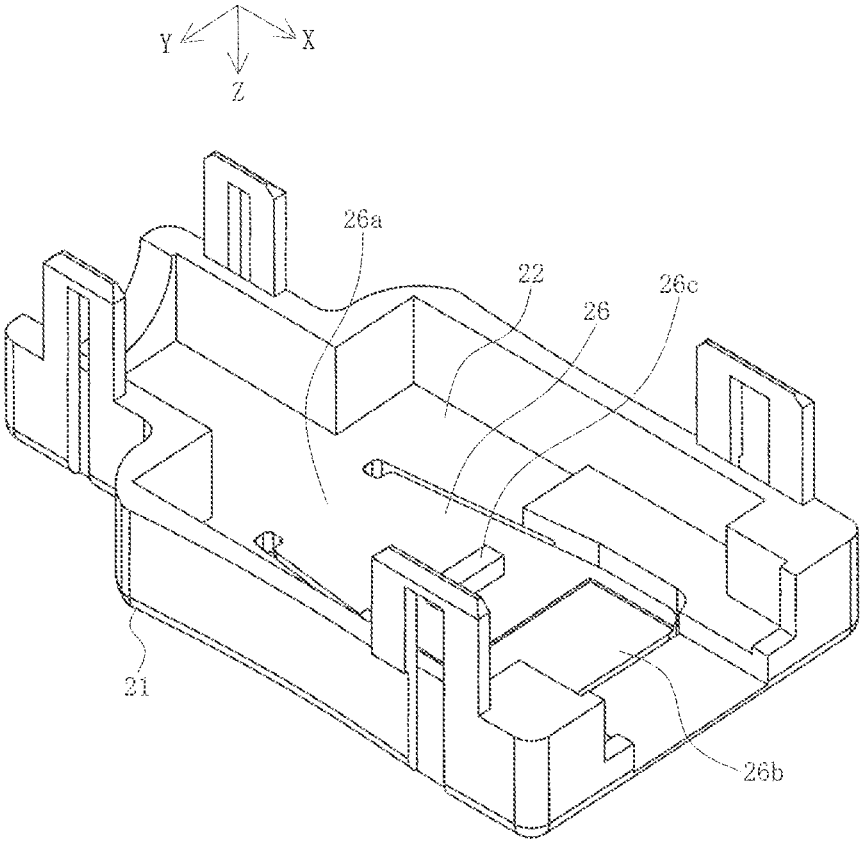
FIG. 7 is a perspective view of an upper cover housing of the wire connector according to the embodiment as viewed from the lower side.
Figure 8:
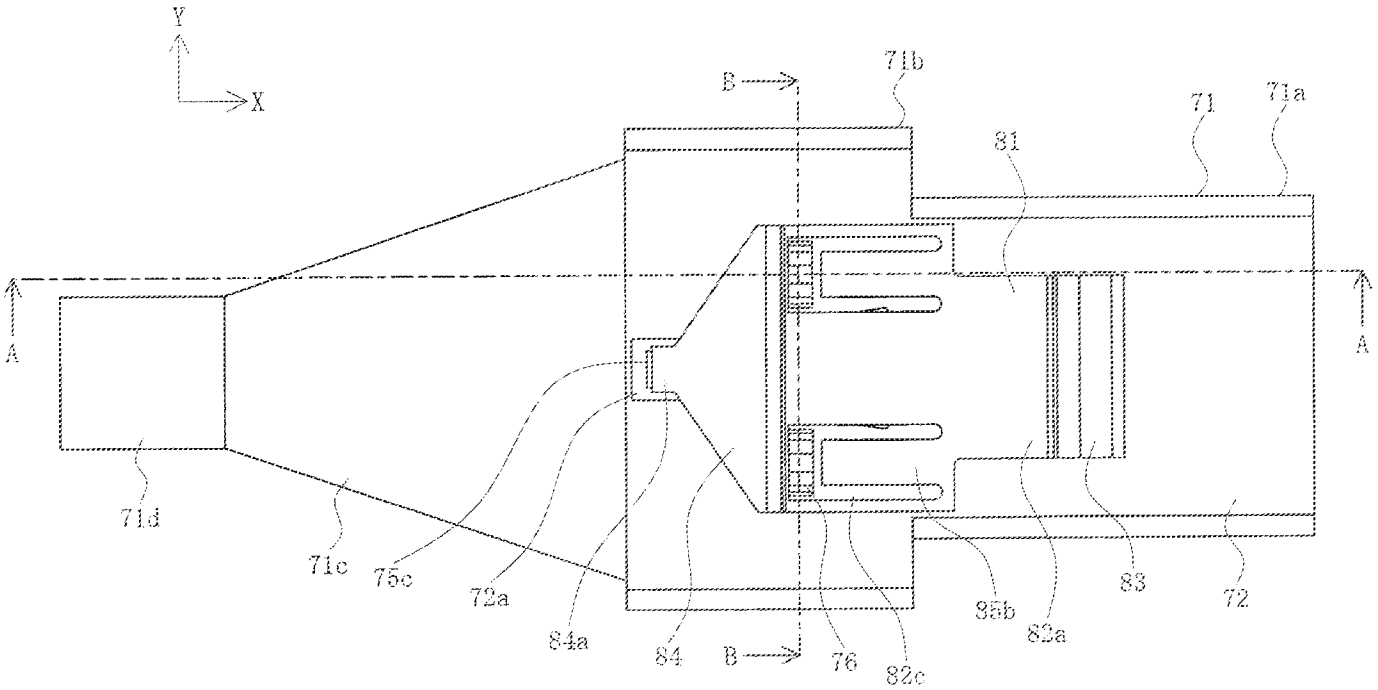
FIG. 8 is a plan view of a part of the wire connector according to the embodiment.
Figure 9A:
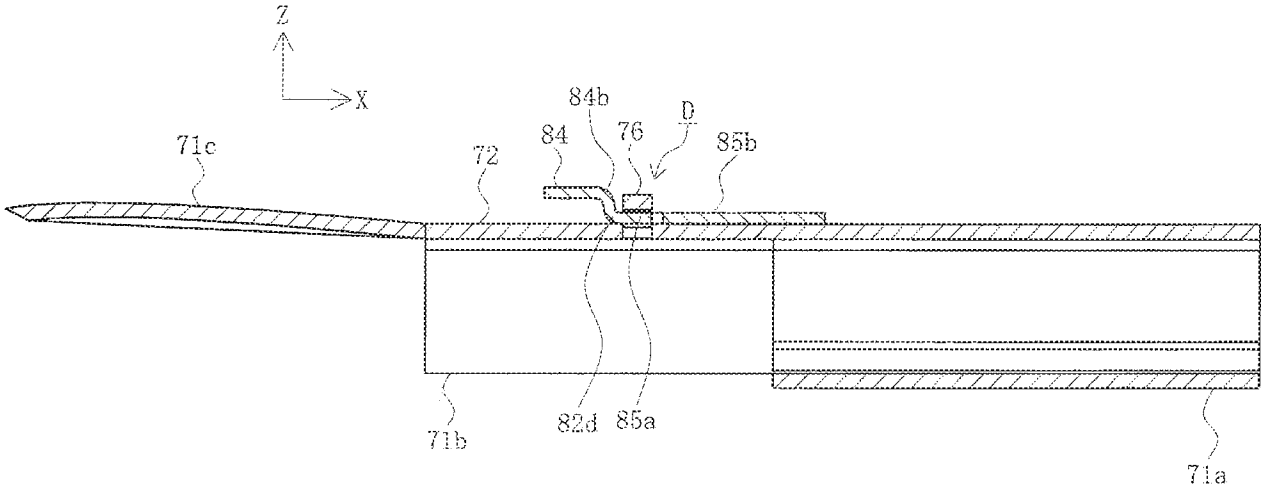
FIGS. 9A and 9B are partial cross-sectional views of the wire connector according to the embodiment, where
Figure 9B:
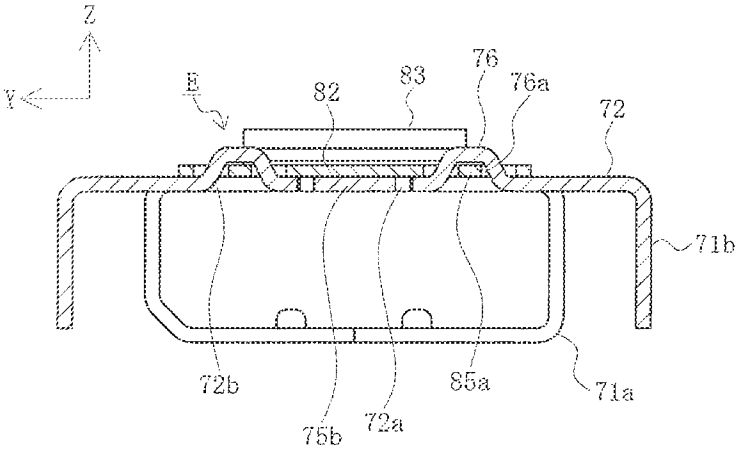
Figure 10A:
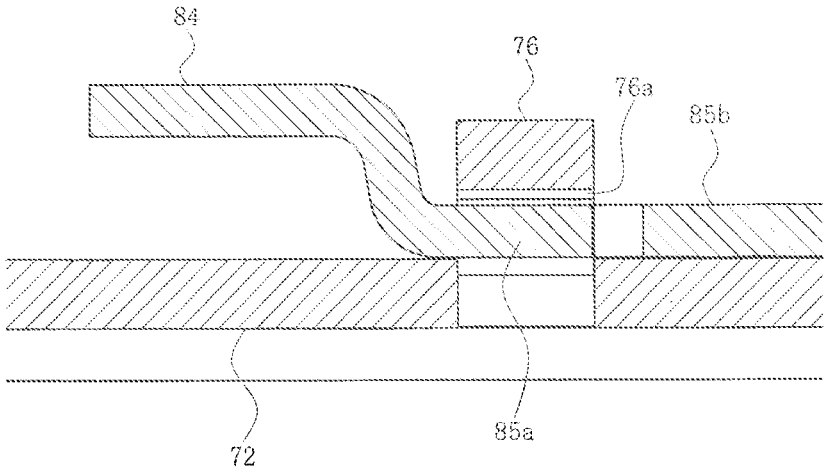
FIGS. 10A and 10B are enlarged cross-sectional views of a main part of the wire connector according to the embodiment, where
Figure 10B:
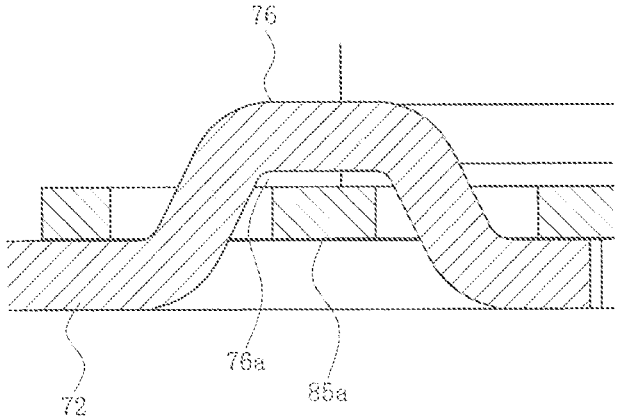

FIG. 1 is a perspective view illustrating a state prior to mating a wire connector and a substrate connector according to an embodiment. FIG. 2 is an exploded view of the wire connector and the substrate connector according to the embodiment. FIG. 3 is an exploded view of a portion of the wire connector according to the embodiment, excluding a cover housing. FIG. 4 is a perspective view of a part of the wire connector according to the embodiment as viewed from the above. FIG. 5 is a perspective view of a part of the wire connector according to the embodiment as viewed from a lower side. FIGS. 6A and 6B are perspective views of a latch member of the wire connector according to the embodiment. FIG. 7 is a perspective view of an upper cover housing of the wire connector according to the embodiment as viewed from the lower side. FIG. 8 is a plan view of a part of the wire connector according to the embodiment. FIGS. 9A and 9B are partial cross-sectional views of the wire connector according to the embodiment. FIGS. 10A and 10B are enlarged cross-sectional views of a main part of the wire connector according to the embodiment. FIG. 6A is a perspective view as viewed from an upper side and FIG. 6B is a perspective view as viewed from a lower side. FIG. 9A is an arrow cross section along the A-A line in FIG. 8, and FIG. 9B is an arrow cross section along the B-B line in FIG. 8. FIG. 10A is an enlarged view of a portion D in FIG. 9A, and FIG. 10B is an enlarged view of a portion E in FIG. 9B.

In the figure, 1 is a wire connector as a connector according to the present embodiment, which is connected to a terminal of a cable 61 including multiple wires 63, and is one type of latch connector including a latch mechanism. Moreover, 101 is a substrate connector as a mating connector mating with the wire connector 1 and mounted on a substrate (not illustrated) such as a printed circuit board contained in electrical equipment, electronic equipment, etc. Note that in the present embodiment, the cable 61 is a long narrow member, while in the figure, for convenience, the illustration of the whole cable is omitted, with only the vicinity of the wire connector 1 illustrated.

The wire connector 1 and the substrate connector 101, for example, form a connector assembly according to the present embodiment, and are used in a variety of electronic equipment such as personal computers, smart phones, along with a variety of equipment such as household equipment, medical equipment, industrial equipment, and transport equipment such as automobiles, but may be used in any application.

Note that expressions for indicating directions such as up, down, left, right, front, and back, used to describe the operations and configurations of the parts of the wire connector 1 and the substrate connector 101 in the present embodiment are not absolute but rather relative directions, and though appropriate when the parts of the wire connector 1 and the substrate connector 101 are in the positions illustrated in the figures, these directions should be interpreted differently when these positions change, in order to correspond to said change.

The wire connector 1 includes a mating part 1*a* mating with the substrate connector 101. Moreover, the wire connector 1 includes a housing 11 integrally formed of an insulating material such as synthetic resin, along with multiple metal terminals 51 installed in the housing 11. The housing 11 is a box shaped member having a substantially rectangular body that stretches in the width direction (Y axis direction) of the wire connector 1 and the mating direction with a mating connector 101, that is, the anteroposterior direction (X axis direction) of the wire connector 1. Additionally, the housing 11 includes an opening part 15 and a connection recess part 13 opened to a front end 11*f* thereof, with multiple terminal housing grooves formed on the upper and lower side walls of the opening part 15. The connection recess part 13 houses the front half of a connection circuit board 16. Additionally, a contact part 54 of each terminal 51 protrudes from each terminal housing groove towards the inside of the opening part 15. The terminals 51 have tail parts 52 to be in contact with (to be electrically connected to) terminal connection pads exposed on a surface of the front half of the connection circuit board 16, due to the elastic force of the terminals 51. Alternatively, the electrical connection may be established by connection means such as soldering.

The cable 61 may be any type of cable such as a single core wire, a coaxial cable, a twist pair cable, flexible flat cable, or a flexible printed circuit board. In the present embodiment described herein, the cable 61 is a shield cable obtained by covering an outer side of a bunch of multiple wires 63 of different types by an external conductor (not illustrated) including braided wires and the like. In the example illustrated in FIG. 3, the cable 61 includes: multiple intermediate cables 62 having multiple wires 63 housed in intermediate covers 62*a* made of an insulating material such as synthetic resin; and multiple wires 63 not housed in the intermediate covers 62*a*. All of the intermediate cables 62 and the wires 63 are housed within an outer cover 61*a* made of an insulating material such as synthetic resin. The outer conductor covers an inner circumference surface of the outer cover 61*a* substantially over the entire length of the cable 61, and has a portion, protruding beyond the front end of the outer cover 61*a*, folded to cover an outer circumference surface of the outer cover 61*a* in the vicinity of the front end. The wires 63 have terminals where wire covers 63*a* made of an insulating material such as synthetic resin is removed so that conductive core wires 64 are exposed. The core wires 64 are electrically connected to the wire connection pads 18 exposed on a surface of a back half of the connection circuit board 16, by connection means such as soldering. The wire connection pads 18 are each connected to a corresponding one of the terminal connection pads, exposed on the surface of the front half of the connection circuit board 16, via a conductive trace (not illustrated). Thus, electrical connection between the wire 63 and the terminal 51 corresponding to each other can be established. Note that the number of wire 63 and terminals 51 can be optionally set.

Moreover, the wire connector 1 includes: a shell 71 which is formed by performing punching, bending, and the like on a conductive metal plate made of phosphor bronze, stainless steel, or the like and covers at least a portion of the periphery of the housing 11 and the connection circuit board 16 in order to EMI (Electro-Magnetic Interference)-shield signals passing therein; and a crimp shell 78 which is formed by performing punching, bending, and the like on a conductive metal plate made of phosphor bronze, stainless steel, or the like and attached to the lower side of the shell 71. The shell 71 and the crimp shell 78 are collectively referred to as a housing. The shell 71 and the crimp shell 78 may be made of synthetic resin or the like.

The shell 71 covers a peripheral portion of the housing 11, and includes a connection part 71*a* that has a rectangular tube shape and can be connected to the substrate connector 101 and a first main body part 71*b* that covers the upper side of the back half of the connection circuit board 16. The shell 71 has a top plate part (top plate surface) 72 stretching entirely over the connection part 71*a* and the first main body part 71*b*. The top plate part 72 has a back end integrally connected with a first tongue piece part 71*c* stretching backward (negative X axis direction). The first tongue piece part 71*c* has a back end integrally connected with a first outer conductor connection part 71*d* stretching backward. The first tongue piece part 71*c* covers the upper sides of the intermediate cable 62 and the wire 63 between the front end of the outer cover 61*a* of the cable 61 and the back end of the connection circuit board 16. The first outer conductor connection part 71*d* covers a part of the outer cover 61*a* of the cover 61 in the vicinity of the front end and is electrically connected with an outer conductor that covers the outer circumference surface of the outer cover 61*a* in the vicinity of the front end.

The crimp shell 78 includes an engagement part (locking part) 78*a* engaged and attached to a portion of the connection part 71*a* of the shell 71 in the vicinity of the back end, and a second main body part 78*b* covering the lower side of the back half of the connection circuit board 16. The second main body part 78*b* has a back end integrally connected with a second tongue piece part 78*c* stretching backward. The second tongue piece part 78*c* has a back end integrally connected with a second outer conductor connection part 78*d* stretching backward. The second tongue piece part 78*c* covers the lower sides of the intermediate cable 62 and the wire 63 between the front end of the outer cover 61*a* of the cable 61 and the back end of the connection circuit board 16. The second outer conductor connection part 78*d* covers and crimps to, that is, caulked to a portion of the outer cover 61*a* of the cable 61 in the vicinity of the front end, and is electrically connected to the outer conductor covering the outer circumference surface of the portion of the outer cover 61*a* in the vicinity of the front end.

The housing formed with the crimp shell 78 attached to the shell 71 includes a tubular connection part, a tubular first main body part including the first main body part 71*b* and the second main body part 78*b*, a tongue piece part including the first tongue piece part 71*c* and the second tongue piece part 78*c*, and an outer conductor connection part including the first outer conductor connection part 71*d* and the second outer conductor connection part 78*d*.

The wire connector 1 further includes an upper side cover housing 21 and a lower side cover housing 31 serving as a cover housing that is integrally formed of an insulating material such as synthetic resin and covers the portion in the vicinity of the back end of the connection part of the housing, the main body part, and the tongue piece part, and the outer conductor connection part. The upper side cover housing 21 includes: a top plate part 22 disposed on the upper side of the top plate part 72 of the shell 71; and side wall parts 23 coupled to both side ends of the top plate part 22. Moreover, the lower side cover housing 31 includes: a bottom plate part 32 disposed on the lower side of the crimp shell 78; and lower side wall parts 33 stretching above both side ends of the bottom plate part 32. Additionally, when a locking opening 24*a*, which is an opening formed in the coupling leg part 24 stretching toward the lower side from the lower end of the upper side wall part 23, is locked to a locking protrusion 33*a* protruding from the lower side wall part 33 of the lower side cover housing 31, the upper side cover housing 21 and the lower side cover housing 31 are coupled to each other so as to cover the peripheral portion of the housing. As illustrated in FIG. 1, with the housing covered by the upper side cover housing 21 and the lower side cover housing 31, the connection part 71*a* of the shell 71 and the portion on the front end 11*f* side of the housing 11 covered by the connection part 71*a* protrude forward of a cover housing front end 21*f* serving as the front end of the upper side cover housing 21, and function as the mating part 1*a*.

The latch member 81 serving as a cantilevered engagement member, which is a member configuring the latch mechanism, is formed on the top plate part 72 of the shell 71 serving as the top plate part of the housing. The latch member 81 made of stainless steel of the like is a plate shaped member integrally formed by performing punching, bending, and the like on a metal plate with a thickness of approximately 0.3 mm for example. The latch member 81 includes a main body part 82 having a flat plate shape, an engagement part 83 connected to the front end of the main body part 82, and an operation part 84 connected to the back end of the main body part 82.

More specifically, as illustrated in FIGS. 6A and 6B, the main body part 82 includes a wide back half part 82*b* and a front half part 82*a* narrower than the back half part 82*b*. An engagement part 83 having a flat plate shape is connected to the front end of the front half part 82*a*. The engagement part 83 is connected to the front end of the front half part 82*a* via a connection step part 83*b* having a substantially cranked shape in side view. With this configuration, the engagement part 83 is positioned above the main body part 82 while being substantially in parallel with the main body part 82. The engagement part 83 has a front end connected to a claw part 83*a* diagonally stretching toward a lower back side. The claw part 83*a* has a front surface 83*c* that is an inclined surface inclined to diagonally stretch toward the lower back side. The operation part 84 is connected to the back end of the back half part 82*b* of the connection step part 84*b* having a substantially crank shape in side view. Thus, the operation part 84 is positioned above the main body part 82 while being substantially in parallel with the main body part 82. The operation part 84 is a flat plate shaped member having a substantially isosceles triangular shape in plan view, and has a part corresponding to an apex of the isosceles triangle connected to a protruding operation piece 84*a* stretching toward the back side. A connection part between the lower end of the connection step part 84*b* and the back end of the back half part 82*b* serves as a fulcrum part 82*d* having a curved shape in side view and functions as a fulcrum for a swinging movement of the latch member 81.

The back half part 82*b* has two right and left parts each provided with a substantially rectangular notched hole (notched part) 82*c* stretching in the anteroposterior direction. The notched hole 82*c* includes a held part (supported part) 85*a* stretching toward the front side and a restriction part 85*b* stretching toward the back side. The held part 85*a* is a long, narrow, and substantially rectangular plate shaped cantilevered member that is formed in the vicinity of the fulcrum part 82*d*, integrally connected to the back half part 82*b* at a back edge of the notched hole 82*c*, and is stretched to the front side from the back edge. The restriction part 85*b* is a long, narrow, and substantially rectangular plate shaped cantilevered member that is integrally connected to the back half part 82*b* at the front edge of the notched hole 82*c*, and stretches toward the back side from the front edge. The restriction part 85*b* is formed to be wider than the held part 85*a*. A gap is formed between tips of the held part 85*a* and the restriction part 85*b*. The restriction part 85*b* may be formed to be thin or hollow to be more easily bendable.

The top plate part 72 of the shell 71 serving as the top plate part of the housing has a spring part 75 and holding parts (supporting part) 76 formed. More specifically, the spring part 75 and the holding parts 76 that are elastic parts are formed on the top plate part 72 of the shell 71 made of a metal plate having a thickness of approximately 0.4 (mm) for example. The spring part 75 is a plate elastic member formed by cutting off a portion of the top plate part 72, and has a base end (fixed end) 75*a* integrally connected to the top plate part 72. Additionally, the peripheral edge of the spring part 75 excluding the base end 75*a* is cut off from the top plate part 72 by forming a notched part 72*a* on the top plate part 72. The base end 75*a* is at a position corresponding to the portion of the top plate part 72 in the vicinity of the front end of the first main body part 71*b*. The spring part 75 is a cantilevered plate spring member stretching backward from the base end 75*a*, and includes: a main body part (engaging main body part) 75*b* having a plate shape with a substantially isosceles triangular shape in plan view; and a protruding part 75*c* serving as a free end of the main body part 75*b*, that is, a free end part connected to the tip. In an initial state with no force added, the main body part 75*b* has an upper surface substantially flush with the upper surface of the top plate part 72 in the periphery. On the other hand, the protruding part 75*c* has a curved shape to protrude upward beyond the upper surface of the top plate part 72.

The main body part 75*b* has a triangular shape in plan view so that the elastic force of the main body part 75*b* can be easily adjusted by adjusting the width and the length of the triangle. The shape of the main body part 75*b* in plan view is not limited to a triangle and may be a rectangle or a trapezoid. The elastically displacement range of the free end of the main body part 75*b* can be adjusted by adjusting the upper protruding amount of the protruding part 75*c*. For example, a downward elastically displacement range of the free end of the main body part 75*b* can be increased by increasing the upper protruding amount of the protruding part 75*c*, and can be reduced by reducing or eliminating the upper protruding amount of the protruding part 75*c*.

One holding part 76 is formed on each of right and left sides of the main body part 75*b* of the spring part 75. As illustrated in FIGS. 9A and 9B, the holding part 76 is an arch or U shaped member formed by cutting, raising, and stretching a part of the top plate part 72, and has both ends integrally connected with the top plate part 72 to have a curved shape and has a center portion protruding above the upper surface of the top plate part 72. A holding opening (through hole) 76*a*, stretched in the anteroposterior direction, is formed between the lower surface of the center portion of the holding part 76 and the upper surface of the top plate part 72. The holding opening 76*a* receives and holds the held part 85*a* of the latch member 81. Specifically, the holding is achieved with loose fitting, that is, with a gap provided between the outer surface of the held part 85*a* and the inner surface of the holding opening 76*a*. The restriction part 85*b* has a width set to be sufficiently larger than that of the holding opening 76*a* and thus does not enter the holding opening 76*a*. With this configuration, displacement of the latch member 81 with respect to the top plate part 72 in the anteroposterior direction can be regulated. The notched part 72*b* is formed on the top plate part 72 as a result of cutting off and raising the holding part 76.

As illustrated in FIGS. 4, 8, 9A and 9B, the latch member 81 is attached to the top plate part 72 of the shell 71 with the pair of right and left held parts 85*a* each inserted in the holding opening 76*a* of a corresponding one of the holding parts 76 from the back side. Specifically, the posture of the latch member 81 is controlled so that the tip of the held part 85*a* is positioned slightly more on the back side than the holding part 76 and a portion of the restriction part 85*b* around its tip is positioned just above the holding part 76. Then, the latch member 81 is positioned above the top plate part 72 and moved downward relative to the top plate part 72 to be pressed against the upper surface of the top plate part 72. As a result, the tip of the restriction part 85*b* is pressed against the upper surface of the holding part 76 to elastically deform to be directed upward. Thus, the portion of the held part 85*a* around its tip faces the holding opening 76*a*. In this state, the latch member 81 is moved forward. As a result, the held part 85*a* is inserted into the holding opening 76*a* from the back side, and the portion of the restriction part 85*b* around the tip is detached from the upper surface of the holding part 76 to return to be at the same height as the held part 85*a* due to the spring property of the restriction part 85*b* itself. In this manner, the latch member 81 is attached to the top plate part 72.

When the latch member 81 is attached to the top plate part 72, the upper side of the main body part 75*b* of the spring part 75 is covered with the back half part 82*b* of the main body part 82 of the latch member 81 and the operation part 84 that can be in contact with the protruding part 75*c* of the spring part 75. As a result, the protruding operation piece 84*a* of the operation part 84 is positioned just above the protruding part 75*c* of the spring part 75. The engagement part 83 is positioned in the vicinity of a middle portion of the connection part 71*a* of the shell 71 in the anteroposterior direction. Instead of making the protruding part 75*c* of the spring part 75 protrude upward, the protruding operation piece 84*a* may protrude downward and have the protruding amount adjusted so that the downward elastic displacement range of the free end of the main body part 75*b* of the spring part 75 can be adjusted.

In the initial state with no force added, the main body part 82 of the latch member 81 attached to the top plate part 72 is placed on the upper surface of the top plate part 72 while being in parallel with the top plate part 72, the operation part 84 is positioned above the top plate part 72 while being in parallel with the top plate part 72, and the protruding operation piece 84*a* is in the vicinity or in contact with the upper surface of the protruding part 75*c* of the spring part 75. The protruding part 75*c* receives no downward force (negative Z axis direction) from the protruding operation piece 84*a*. Thus, the main body part 75*b* of the spring part 75 is not deformed and thus is flush with the top plate part 72 in the periphery.

A latch operating part 26 having a plate shape is formed on the top plate part 22 of the upper side cover housing 21 by cutting off a part of the top plate part 22. The latch operating part 26, forming the latch mechanism, is a plate elastic member integrally formed with the top plate part 22, with a base end 26*a* thereof integrally connected to the top plate part 22. The latch operating part 26 is a cantilevered plate spring shaped member stretching fonvard from a base end 26*a* thereof positioned on the back half of the top plate part 22, and has a tip 26*b*, which is a free end, positioned in the vicinity of the front end of the top plate part 22. The upper surface of the latch operation part 26 is substantially flush with the upper surface of the top plate part 22 and has a protruding part 26*c* protruding downward at a position in the vicinity of a middle portion of the base end 26*a* and the tip 26*b* on the lower surface of the latch operation part 26 as illustrated in FIG. 7.

As illustrated in FIG. 1, in the state where the housing is covered by the upper side cover housing 21 and the lower side cover housing 31, the front half part of the connection part 71*a* of the shell 71 and the engagement part 83 of the latch member 81 protrude forward beyond the cover housing front end 21*f* of the upper side cover housing 21. The other part of the housing is covered by the upper side cover housing 21 and the lower side cover housing 31. Additionally, in the state where the housing is covered by the upper side cover housing 21 and the lower side cover housing 31, the protruding part 26*c* is disposed just above the protruding operation piece 84*a* of the latch member 81; and thereby, when the operator presses down the latch operation part 26 by finger, the protruding operation piece 84*a* of the latch member 81 is pressed down. When the protruding operation piece 84*a* is pressed down, the latch member 81 swings about the fulcrum part (standing part) 82*d* in contact with the upper surface of the top plate part 72 of the shell 71. As a result, the front end of the main body part 82 moves up, and thereby the engagement part 83 is raised.

When the protruding operation piece 84*a* is pressed down, the protruding operation piece 84*a* presses down the protruding part 75*c*, and thus the main body part 75*b* of the spring part 75 elastically deforms so that the free end is displaced downward. As a result, the spring part 75 that is a cantilevered plate spring member exerts reaction force, and thus the protruding operation piece 84*a* receives upward spring force (positive Z axis direction) from the protruding part 75*c*. Thus, when the operator releases the force for pressing down the latch operation part 26, the latch member 81 swings in the opposite direction about the fulcrum part 82*d* in contact with the upper surface of the top plate part 72 of the shell 71. As a result, the front end of the main body part 82 moves downward so that the engagement part 83 is displaced downward. In this manner, the latch member 81 returns to the posture in the initial state. Similarly, the latch operation part 26 returns to the posture in the initial state with the upper surface of the latch operation part 26 being substantially flush with the upper surface of the top plate part 22.

In contrast, the substrate connector 101 includes: a mating housing 111 which is integrally formed of an insulating material such as a synthetic resin and mates with the wire connector 1; and multiple metal mating terminals 151 installed in the mating housing 111. The mating housing 111 is a box shaped member having a substantially rectangular body that stretches in the width direction of the substrate connector 101 and the mating direction of the wire connector 1, that is, the anteroposterior direction of the substrate connector 101. Additionally, the mating housing 111 includes a tongue shaped part 115 protruding forward, with contact parts 154 of the mating terminals 151 arranged on each of the upper surface and the lower surface of the tongue shaped part 115 along the width direction (Y axis direction) of the substrate connector 101. Tail parts 152 of the mating terminal 151 are provided side by side in the width direction of the substrate connector 101 and are electrically connected to a connection pad on the surface of a substrate (not illustrated) by means such as soldering. Note that the number of the mating terminals 151 can be optionally changed.

Moreover, the substrate connector 101 includes a mating shell 171 which is made of a conductive metal plate made of stainless steel or the like and covers the peripheral portion of the mating housing 111 in order to EMI-shield signals passing therein. The mating shell 171 includes: a top plate part 172 covering the upper surface of the housing 111; and side wall parts 173 coupled to both side ends of the top plate part 172 so as to cover the right and left side surfaces of the housing 111. Further, the side wall part 173 includes multiple (four in the example illustrated in the figure) attaching legs 177 that stretch downward from the lower end thereof. The attaching leg 177 is inserted and fixed into an attaching hole formed in the substrate (not illustrated), whereby the substrate connector 101 is assuredly fixed to the substrate. A mating engagement part (receiving part) 172*a* gently curved upward is integrally formed with the front end 172*f* of the top plate part 172.

Next, the operation of the wire connector 1 will be described. First, the operation of the mating wire connector 1 with the substrate connector 101 will be described.

Figure 11:
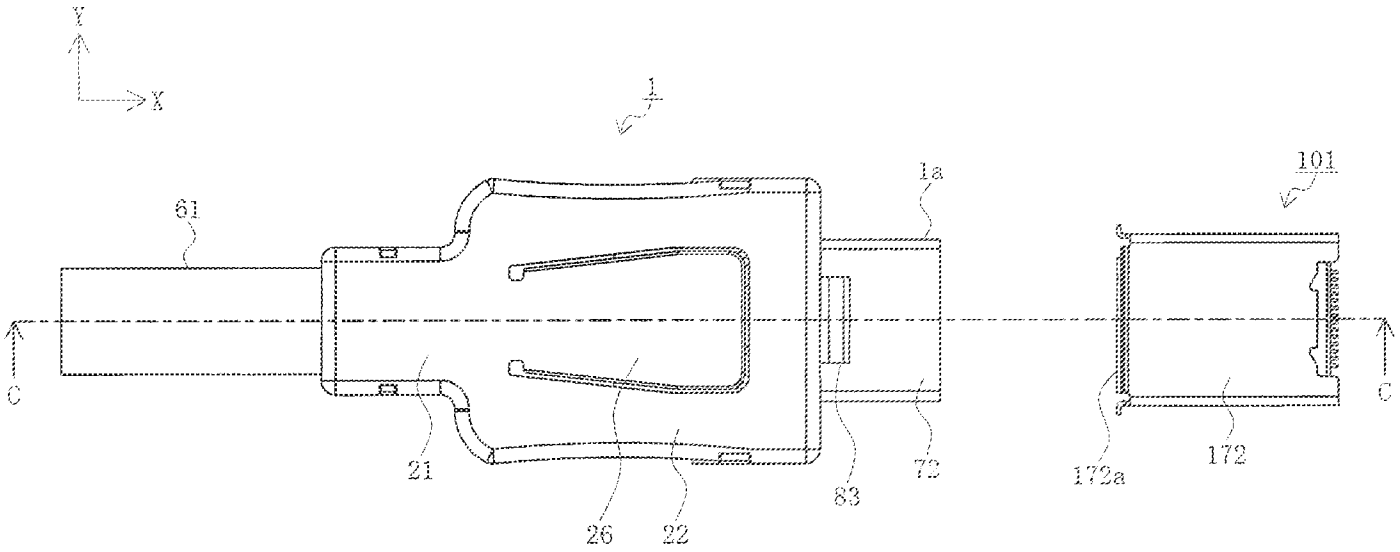
FIG. 11 is a plan view illustrating a state prior to mating the wire connector and the substrate connector according to the embodiment.
Figure 12:
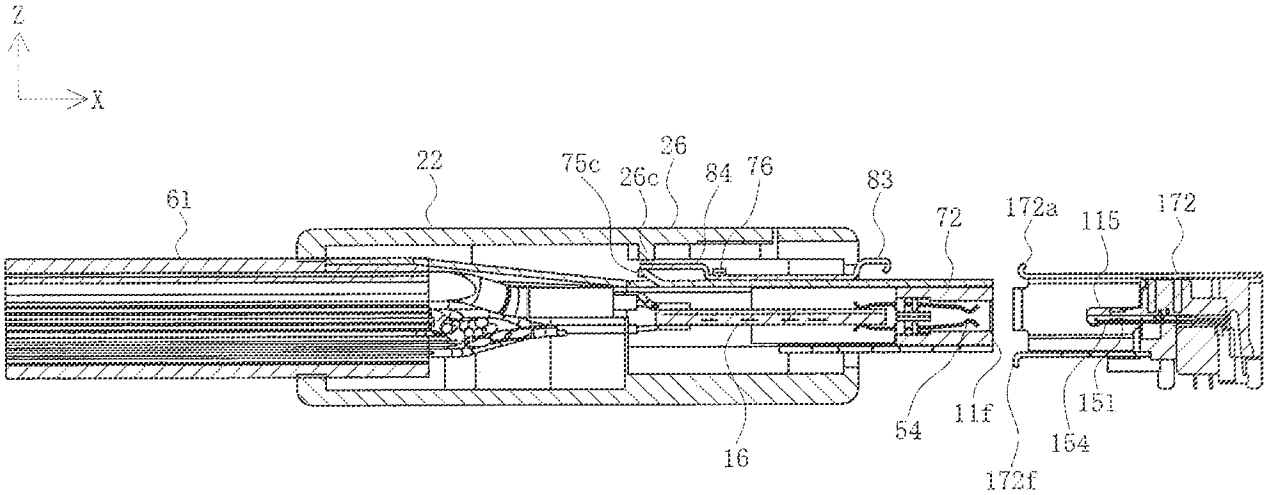
FIG. 12 is a longitudinal cross sectional view illustrating the state prior to mating the wire connector and the substrate connector according to the embodiment, and corresponding to an arrow cross section along line C-C in FIG. 11.
Figure 13:
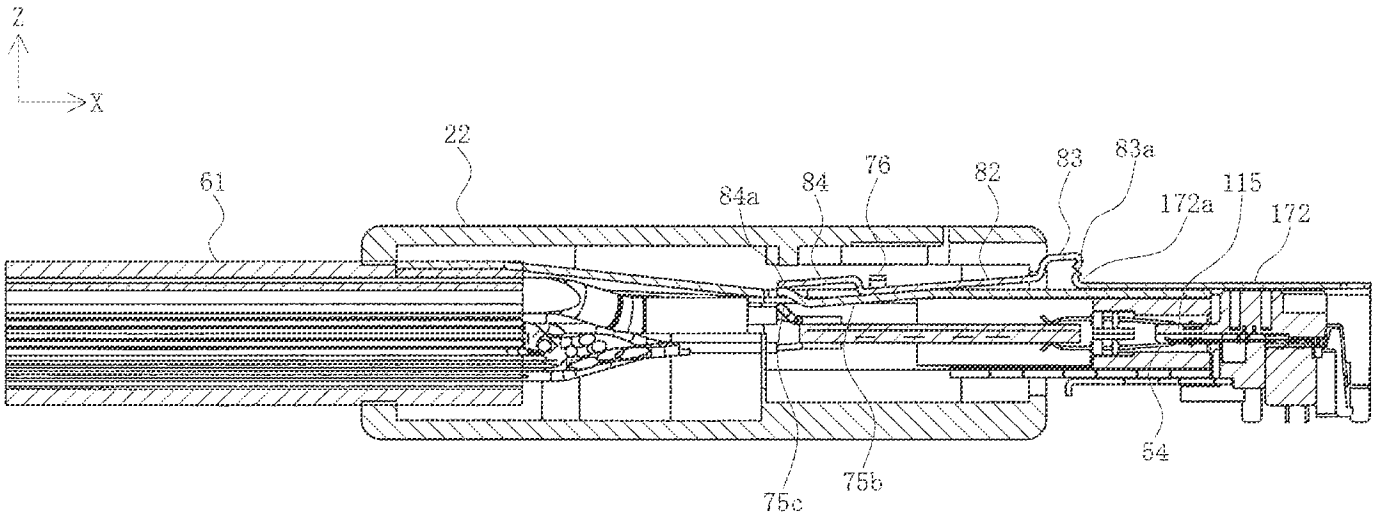
FIG. 13 is a longitudinal cross sectional view illustrating a halfway state of mating the wire connector and the substrate connector according to the embodiment.
Figure 14:
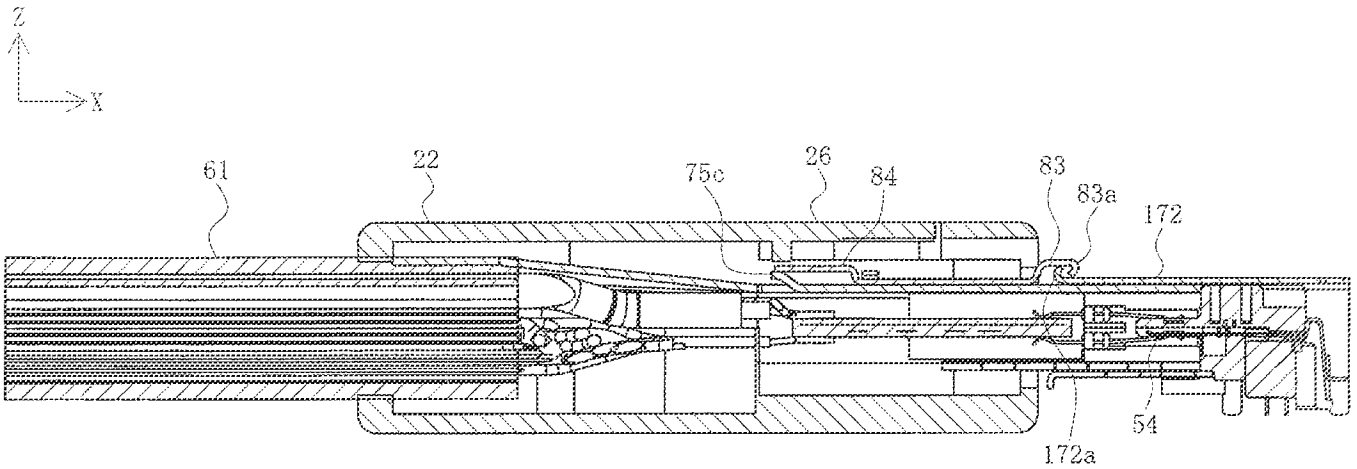
FIG. 14 is a longitudinal cross sectional view illustrating a state after mating the wire connector and the substrate connector according to the embodiment.

FIG. 11 is a plan view illustrating a state prior to mating the wire connector and the substrate connector according to the embodiment. FIG. 12 is a longitudinal cross sectional view illustrating the state prior to mating the wire connector and the substrate connector according to the embodiment, and corresponding to an arrow cross section along line C-C in FIG. 11. FIG. 13 is a longitudinal cross sectional view illustrating a halfway state of mating the wire connector and the substrate connector according to the embodiment. FIG. 14 is a longitudinal cross sectional view illustrating a state after mating the wire connector and the substrate connector according to the embodiment.

First, an operator, as illustrated in FIGS. 1, 11, and 12, opposes the wire connector 1 to the substrate connector 101 mounted on the substrate. That is, the front end 11*f* of housing 11 is opposite the tongue shaped part 115 of the mating housing 111 housed in the cavity of the mating shell 171. At this point, the latch member 81 placed on the top plate part 72 of the shell 71 is in the initial state, with the held part 85*a* inserted in the holding opening 76*a* of the holding part 76 but is not receiving any force and thus is not deformed or displaced. Similarly, the spring part 75 is in the initial state where no force is applied thereto, and thus is not deformed or displaced.

The operator relatively moves the wire connector 1 toward the substrate connector 101, and thus the front end 11*f* of the housing 11 is moved so as to approach the front end 172*f* of the top plate part 172.

Next, the operator further moves the wire connector 1, so that as illustrated in FIG. 13, the mating part 1*a* is inserted into the cavity of the mating shell 171, with the tongue shaped part 115 of the mating housing 111 relatively inserted into the opening part 15 of the housing 11. In this state, the mating engagement part 172*a* of the top plate part 172 is gently curved upward. The front surface 83*c* of the claw part 83*a* at the front end of the engagement part 83 of the latch member 81 positioned above the top plate part 72 of the shell 71 is an inclined surface inclined to diagonally stretch toward the lower back side. Thus, the engagement part 83 moves forward with the front surface 83*c* of the claw part 83*a* in sliding contact with the mating engagement part 172*a* of the top plate part 172, to be smoothly pressed upward and thus can easily climb over the mating engagement part 172*a*, even when the operator does not press down the latch operation part 26 to press down the engagement part 83 of the latch member 81.

With the engagement part 83 pressed upward, the latch member 81 swings about the fulcrum part 82*d*, so that the protruding operation piece 84*a* moves downward to press down the protruding part 75*c* of the spring part 75 and thus the main body part 75*b* is deformed. As a result, the engagement part 83 receives downward biasing force due to the spring force of the spring part 75. The biasing force may serve as a resistance against the engagement part 83 climbing over the mating engagement part 172*a* of the top plate part 172. However, the distance between the fulcrum part 82*d* and the engagement part 83 is sufficiently longer than that between the fulcrum part 82*d* and the protruding operation piece 84*a*. Thus, the downward biasing force added to the engagement part 83 is much smaller than the spring force added to the protruding operation piece 84*a* from the protruding part 75*c* of the spring part 75 due to the principle of leverage. Thus, the biasing force will not be a substantial resistance against the engagement part 83 climbing over the mating engagement part 172*a* of the top plate part 172. The main body part 75*b* lowering to be below the top plate part 72 of the shell 71, due to the protruding part 75*c* of the spring part 75 pressed down, may interfere with the wire 63 and the like positioned below the top plate part 72. However, the distance between the engagement part 83 and the fulcrum part 82*d* is sufficiently longer than the distance between the protruding operation piece 84*a* and the fulcrum part 82*d*. Thus, the downward displacement amount of the protruding part 75*c* and the main body part 75*b* is much smaller than the upward displacement amount of the engagement part 83. Thus, the protruding part 75*c* and the main body part 75*b* do not interfere with the wire 63 and the like.

Subsequently, when the operator further moves the wire connector 1, as illustrated in FIG. 14, the mating between the wire connector 1 and the substrate connector 101 is completed. As a result, the overall tongue shaped part 115 of the mating housing 111 is inserted into the opening part 15 of the housing 11, while the contact part 54 of each terminal 51 contacts a corresponding contact part 154 of the mating terminal 151 so as to be conductive. The engagement part 83 of the latch member 81 biased downward due to the spring force of the spring part 75 has climbed over the mating engagement part 172*a* of the top plate part 172 of the mating shell 171, and thus is downwardly displaced. As a result, the claw part 83*a* of the engagement part 83 is engaged with the mating engagement part 172*a* of the top plate part 172. As a result, the shell 71 of the wire connector 1 is latched by the mating shell 171 of the substrate connector 101, preventing the wire connector 1 from being separated from the substrate connector 101 and releasing the mating.

In the present embodiment, the engagement part 83 including the claw part 83*a* is a wide and rigid member having a dimension that is ½ of that of the shell 71 or larger in the width direction of the wire connector 1 as illustrated in FIG. 4 and the like. Thus, the engagement part 83 does not deform even when large tensile force is added to the wire connector 1, whereby the engagement between the engagement part 83 and the mating engagement part 172*a* of the top plate part 172 of the mating shell 171 is assuredly maintained. Accordingly, the wire connector 1 can be assuredly prevented from being separated from the substrate connector 101 and releasing the mating. The pair of right and left held parts 85*a* stretching forward are inserted in the holding openings 76*a* of the pair of right and left holding parts 76 integrally formed on the top plate part 72 of the shell 71 from the back side to be supported. Thus, even when force of pulling the top plate part 72 of the shell 71 forward is added due to large tensile force added to the wire connector 1, the held part 85*a* does not come off the holding opening 76*a*, and the latch member 81 does not come off the top plate part 72. When force of pulling the top plate part 72 of the shell 71 forward is added to the latch member 81, the wide connection step part 84*b* positioned on the back side of the held part 85*a* comes into contact with the back surfaces of the pair of right and left holding parts 76. Thus, the latch member 81 can be assuredly prevented from coming off the top plate part 72. The holding part 76 has both ends integrally connected with the top plate part 27 to be an arch shaped member, and thus is rigid enough not to be damaged even when the force of pulling the top plate part 72 of the shell 71 forward is added to the latch member 81. Thus, the latch member 81 is more effectively prevented from coming off the top plate part 72. In a state where the mating between the wire connector 1 and the substrate connector 101 is completed, the spring part 75 is in an initial state with no force added thereto, and thus has high durability and is not settled.

Next, the operation of releasing the mating between the wire connector 1 and the substrate connector 101 will be described.

Figure 15:
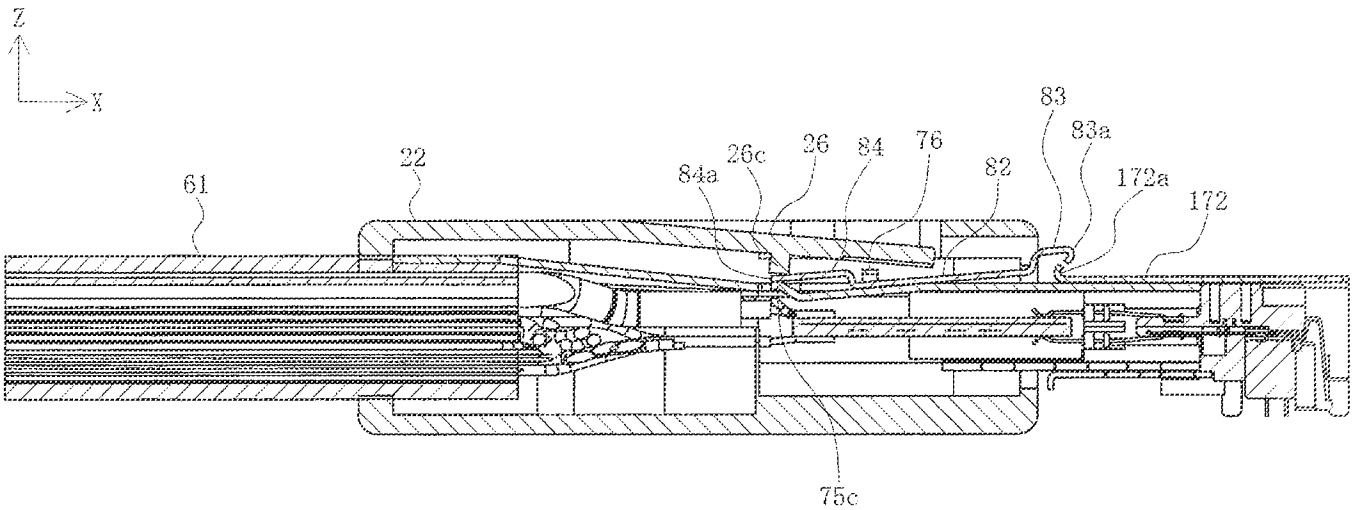
FIG. 15 is a longitudinal cross sectional view illustrating a state of having started an operation of releasing the mating between the wire connector and the substrate connector according to the embodiment.
Figure 16:
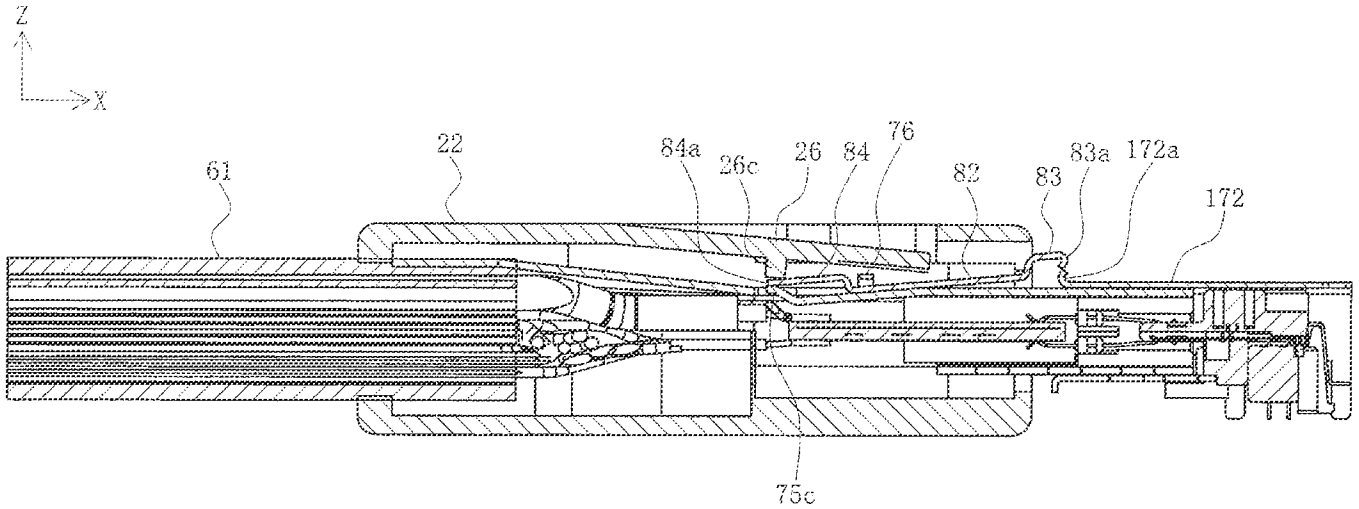
FIG. 16 is a longitudinal cross sectional view illustrating a halfway state of releasing the mating between the wire connector and the substrate connector according to the embodiment.
Figure 17:
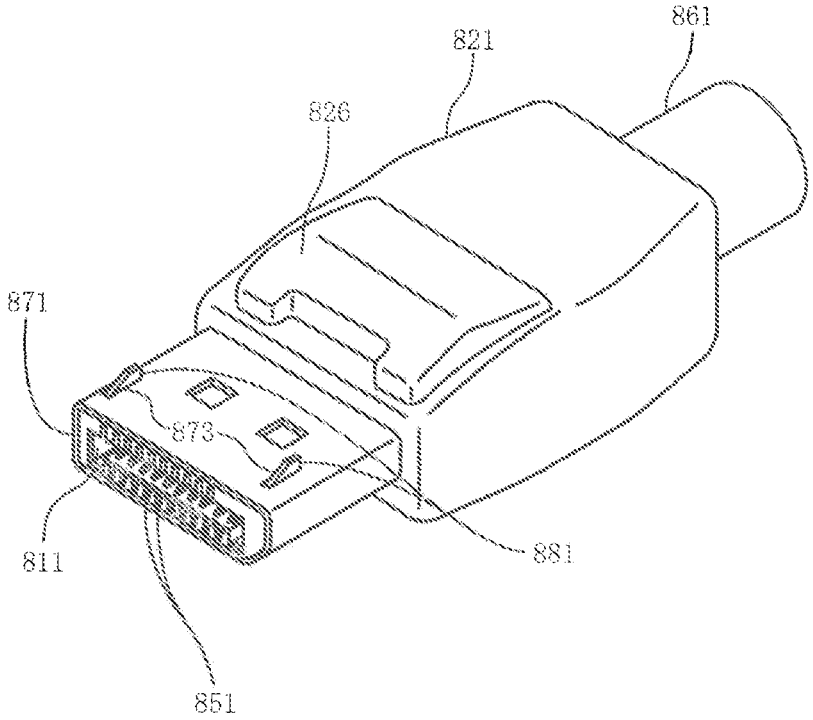
FIG. 17 Prior Art
FIG. 17 is a view illustrating a conventional latch connector.

FIG. 15 is a longitudinal cross sectional view illustrating the state of having started the operation of releasing the mating between the wire connector and the substrate connector according to the present embodiment, and FIG. 16 is a longitudinal cross sectional view illustrating the halfway state of releasing the mating between the wire connector and the substrate connector according to the present embodiment.

First, when an operator presses down the latch operation part 26 with finger, the protruding operation piece 84*a* of the latch member 81 is pressed down. As a result, the latch member 81 swings about the fulcrum part 82*d* so that the front end of the main body part 82 moves upward, and the engagement part 83 is raised. Thus, the mating between the claw part 83*a* of the engagement part 83 and the mating engagement part 172*a* of the top plate part 172 of the mating shell 171 is released. As a result, the latch between the shell 71 of the wire connector 1 and the mating shell 171 of the substrate connector 101 is released and the wire connector 1 is separated from the substrate connector 101, enabling the mating to be released.

The distance between the fulcrum part 82*d* and the engagement part 83 is sufficiently longer than the distance between the fulcrum part 82*d* and the protruding operation piece 84*a*. Thus, the upward displacement amount of the engagement part 83 is much larger than the downward displacement amount of the protruding operation piece 84*a* due to the principle of leverage. This means that the operator needs not to press down the latch operation part 26 by a large operation amount. When the protruding operation piece 84*a* of the latch member 81 is pressed down, the protruding operation piece 84*a* is lowered to press down the protruding part 75*c* of the spring part 75 so that the main body part 75*b* is deformed. Thus, the upward biasing force is added to the protruding operation piece 84*a* due to the spring force of the spring part 75. This biasing force may serve as a resistance when the latch operation part 26 is pressed down. However, the force applied with the finger of the operator is sufficiently larger than the spring force of the spring part 75. Thus, the upward biasing force added to the protruding operation piece 84*a* would not be a substantial resistance when the latch operation part 26 is pressed down.

When the operator presses down the latch operation part 26 by a large operation amount, the protruding part 75*c* of the spring part 75 is pressed down by a large amount. Thus, the main body part 75*b* is more largely moved downward below the top plate part 72 of the shell 71, and thus might interfere with the wire 63 and the like positioned below the top plate part 72. However, as can be seen in FIGS. 4 and 8 and the like, the operation part 84 having the isosceles triangular shape has a dimension in the width direction of the wire connector 1 larger that of the main body part 75*b* of the spring part 75 that is positioned therebelow and has an isosceles triangular shape and that of the notched part 72*a* that has an isosceles triangular shape. Thus, when the protruding operation piece 84*a* positioned at an apex of the operation part 84 having the isosceles triangular shape and the protruding part 75*c* positioned at an apex of the main body part 75*b* having the isosceles triangular shape are lowered together by a large amount, the two equal sides of the operation part 84 having the isosceles triangular shape interfere with the two equal sides of the notched part 72*a* having an isosceles triangular shape formed on the top plate part 72 as a result of cutting off the spring part 75. As a result, the lowering movement of the protruding operation piece 84*a* and the protruding part 75*c* stops. In other words, when the latch operation part 26 is pressed down so that the protruding part 75*c* of the spring part 75 is pressed down via the protruding operation piece 84*a*, the operation part 84 interferes with the notched part 72*a*. Thus, the downward displacement amounts of the protruding part 75*c* and the main body part 75*b* of the spring part 75 are limited so as not to be excessively large. All things considered, the protruding part 75*c* and the main body part 75*b* do not interfere with the wire 63 and the like.

Next, the operator pulls and thus moves the wire connector 1 backward in the state where the engagement between the claw part 83*a* of the engagement part 83 and the mating engagement part 172*a* of the top plate part 172 are released with the latch operation part 26 pressed down maintained, to move away from the substrate connector 101. Then, as illustrated in FIG. 16, the claw part 83*a* at the front end of the engagement part 83 of the latch member 81 is positioned more on the back side than the mating engagement part 172*a* of the top plate part 172 of the mating shell 171.

Subsequently, when the wire connector 1 is further moved backward, releasing of the mating between the wire connector 1 and the substrate connector 101 is completed, with the wire connector 1 detached from the substrate connector 101.

As described above, in the present embodiment, the wire connector 1 includes the housing 11, the shell 71, the terminals 51 installed in the housing 11, and the latch member 81. The top plate part 72 of the shell 71 includes the spring part 75 that is formed by cutting off a part of the top plate part 72 and has a cantilever form. The latch member 81 includes the main body part 82, the engagement part 83 connected with the front end of the main body part 82, and the operation part that is connected to the back end of the main body part 82 and can be in contact with the protruding part 75*c* of the spring part 75. The latch member 81 is swingably attached to the top plate part 72.

As a result, the latch member 81 has high rigidity and deformations such as twisting tend not to occur, allowing latching strength to be increased without enlarging the dimensions such that even when unexpected external force is added, the latch is not released.

The main body part 82 of the latch member 81 includes the fulcrum part 82*d* serving as the fulcrum of the swinging movement, the pair of right and left held parts 85*a* formed in the vicinity of the fulcrum part 82*d*. The held part 85*a* are each held by a corresponding one of the pair of right and left holding parts 76 formed on the top plate part 72. The latch member 81 thus held with the two portions on the right and left sides is highly stable, such that even when unexpected external force is added, the latch is not released.

The holding parts 76 each have both ends connected to the top plate part 72 to be an arch shaped member, and include the holding opening 76*a* formed between the holding part 76 and the upper surface of the top plate part 72. The held parts 85*a* are loose fit in the holding opening 76*a* to be held. With this configuration, the holding part 76 can have high rigidity, and thus the latch member 81 can be prevented from coming off the shell 71, even when unexpected external force is applied. The latch member 81 can have the posture changed so that the latch is not released.

The main body part 82 of the latch member 81 includes the pair of right and left notched holes 82*c* that are stretched in the anteroposterior direction and have a substantially rectangular shape. Each of the held parts 85*a* is integrally connected to the main body part 82 at the back edge of a corresponding one of the notched holes 82*c*, and is stretched forward from the back edge. Each of the notched holes 82*c* includes the restriction part 85*b* stretched backward from the front edge thereof, with a gap provided between the tips of the restriction part 85*b* and the held part 85*a*. Thus, the latch member 81 does not come off the shell 71 even when large tensile force is added.

The lower surface of the main body part 82 of the latch member 81 is substantially flush with the upper surface of the top plate part 72, and the operation part 84 is positioned above the upper surface of the top plate part 72. The spring part 75 is a plate spring stretched backward from the base end 75*a* connected to the top plate part 72, and is formed between the pair of right and left holding parts 76. The upper surface of the main body part 75*b* of the spring part 75 is substantially flush with the upper surface of the top plate part 72. The protruding part 75*c* of the spring part 75 protrudes upward beyond the upper surface of the top plate part 72.

The held part 85*a* of the latch member 81 is held by the holding part 76 to be movable in upward, downward, left, and right directions. Thus, the held part 85*a* is not elastically deformed even when the latch member 81 is tilted while the wire connector 1 and the substrate connector 101 are mated together or while the mating is released. Thus, the latch member 81 itself does not elastically deform, and the held part 85*a* would not be damaged or deformed, whereby the latch member 81 can be prevented from coming off.

The wire connector 1 includes the spring part 75 formed on the shell 71 and the latch member 81. The spring part 75 elastically deforms toward the inner side of the shell 71 to bias the latch member 81 in a clockwise direction in FIGS. 12 to 16. Thus, no extra space needs to be secured for elastic deformation of the spring part 75, whereby the wire connector 1 can be downsized.

The protruding part 75*c* is formed at the tip of the spring part 75, so that a sufficient elastically deformable range can be secured for the elastic deformation of the spring part 75 toward the inner side of the shell 71.

In the present embodiment described above, the spring part 75 is formed on the top plate part 72 of the shell 71. Alternatively, the spring part 75 may be formed on the crimp shell 78 or may be formed on both of the shell 71 and the crimp shell 78. When the spring part 75 is formed on the crimp shell 78, the latch operation part 26 may be formed on the lower side cover housing 31.

The holding parts 76 are formed on both sides in the width direction of the housing 11 orthogonal to the mating direction. Thus, the elastic force of the spring part 75 can be adjusted by changing the dimension of the spring part 75, without being affected by the positions of the holding part 76. In the example described above, the holding parts 76 are formed on both sides of the spring part 75 and are formed around the center in the mating direction. Note that the holding parts 76 may be formed at any positions to be in parallel with the mating direction of the spring part 75, and the number and the positions of the holding parts 76 can be optionally changed.

The latch member 81 does not include the spring part 75 and thus no complex spring part 75 is required. Thus, the wire connector 1 can have a simple structure and can be manufactured at a low cost. Only the examples where the material of the spring part 75 is metal is described. Note that the spring part 75 may be made of any material as long as the mating with the substrate connector 101 can be assuredly maintained.

The operation part 84 of the latch member 81 tilts the latch member 81 to be involved in processes of mating with the substrate connector 101 and releasing the mating. Thus, force added to the operation part 84 is preferably transmitted to the engagement part 83 via the fulcrum part 82*d*. Specifically, the engagement part 83 preferably deforms smoothly with the force added to the protruding part 75*c* of the spring part 75 transmitted entirely over the fulcrum part 82*d* in the left and right direction without being dispersed. Thus, with the operation part 84 having a substantially triangular shape, the force added can be transmitted entirely over the fulcrum part 82*d*, whereby the engagement part 83 can be assuredly deformed.

Furthermore, the latch member 81 can move relative to the shell 71 within a movement restriction range. Thus, the wire connector 1 and the substrate connector 101 can be assuredly mated without any influence of mating failure due to dimensional tolerance.

In the description above, the materials of the shell 71 and the mating shell 171 are phosphor bronze, stainless steel, and the like. Alternatively, any type of material may be selected as long as mechanical strength, electrical characteristics, and the like can be achieved. The material is preferably a conducting material, but may also be an insulating material.

Note that the present disclosure according to the present specification is only one example, and thus any appropriate change that preserves the gist of the present disclosure and can easily be conceived by a person skilled in the art is within the scope of the present disclosure. The widths, thicknesses, and shapes of the portions illustrated in the drawing are illustrated schematically and are not intended to limit the interpretation of the present disclosure.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to a connector and a connector assembly.

The invention claimed is:

1. A connector comprising:

a shell, the shell having a top plate part, the top plate part having a spring part, the spring part having a free end portion; and a latch member, the latch member being attached to the top plate part in a manner which allows for swinging movement, the latch member has a main body part, an engagement part and an operation part, the engagement part being connected to a front end of the main body part, the operation part being connected to a back end of the main body part, the operation part being configured to contact the free end portion, wherein the main body part has a fulcrum part serving as a fulcrum of the swinging movement, wherein the main body part has at least one held part proximate to the fulcrum part, and wherein the top plate part has at least one holding part, the at least one held part configured to be held by the at least one holding part.

2. The connector according to claim 1, wherein the at least one holding part is formed as an arch shaped member, wherein a holding opening is defined between the at least one holding part and an upper surface of the top plate part, and wherein the at least one held part is loose fit in the holding opening to be held.

3. The connector according to claim 1, wherein the main body part has at least one notched hole, the at least one notched hole being stretched in an anteroposterior direction and having a substantially rectangular shape, wherein the at least one held part is integrally connected to the main body part at a back edge of the at least one notched hole, the at least one held part being stretched forward from the back edge, wherein the main body part has at least one restriction part integrally connected thereto at a front edge of the at least one notched hole, the at least one restriction part being stretched backward from the front edge, and wherein a gap is provided between a free end of the at least one restriction part and a free end of the at least one held part.

4. A connector comprising:

a shell, the shell having a top plate part, the top plate part having a spring part, the spring part having a free end portion; and a latch member, the latch member being attached to the top plate part in a manner which allows for swinging movement, the latch member has a main body part, an engagement part and an operation part, the engagement part being connected to a front end of the main body part, the operation part being connected to a back end of the main body part, the operation part being configured to contact the free end portion of the spring part, wherein the main body part has a lower surface that is substantially flush with an upper surface of the top plate part, and wherein the operation part is positioned above the upper surface of the top plate part.

5. A connector comprising:

a shell, the shell having a top plate part, the top plate part having a spring part, the spring part having a free end portion; and a latch member, the latch member being attached to the top plate part in a manner which allows for swinging movement, the latch member has a main body part, an engagement part and an operation part, the engagement part being connected to a front end of the main body part, the operation part being connected to a back end of the main body part, the operation part being configured to contact the free end portion of the spring part, wherein a pair of held parts are formed on the main body part, wherein a pair of holding parts are formed on the top plate part wherein the pair of holding parts are configured to hold the pair of held parts, and wherein the spring part has a base end connected to the top plate part, the spring part being a plate spring stretched backward from the base end, the spring part being formed between the pair of holding parts.

6. A connector comprising:

a shell, the shell having a top plate part, the top plate part having a spring part, the spring part having a free end portion; and a latch member, the latch member being attached to the top plate part in a manner which allows for swinging movement, the latch member has a main body part, an engagement part and an operation part, the engagement part being connected to a front end of the main body part, the operation part being connected to a back end of the main body part, the operation part being configured to contact the free end portion of the spring part, wherein the spring part has a main body part, wherein an upper surface of the main body part of the spring part is substantially flush with an upper surface of the top plate part, and wherein the free end portion of the spring part protrudes upward beyond the upper surface of the top plate part.

7. A connector assembly comprising: the connector according to claim 1; and a mating connector that includes a mating engagement part capable of engaging with the engagement part of the latch member, the mating connector being capable of mating with the connector.

8. The connector according to claim 1, wherein the spring part has a cantilever form and is formed by cutting off a part of the top plate part.

9. The connector according to claim 1, further comprising:

a housing; and a terminal installed in the housing, wherein the shell covers a peripheral portion of the housing.

10. The connector according to claim 9, further comprising a cover housing, the cover housing having a top plate part which is disposed on an upper side of the top plate part of the shell.

11. The connector according to claim 10, wherein the top plate part of the cover housing has a latch opening part formed therein, the latch operating part configured to be manipulated to cause the swinging movement.

12. The connector according to claim 4, wherein the spring part has a cantilever form and is formed by cutting off a part of the top plate part.

13. The connector according to claim 4, further comprising:

a housing; and a terminal installed in the housing, wherein the shell covers a peripheral portion of the housing.

14. The connector according to claim 13, further comprising a cover housing, the cover housing having a top plate part which is disposed on an upper side of the top plate part of the shell.

15. The connector according to claim 14, wherein the top plate part of the cover housing has a latch opening part formed therein, the latch operating part configured to be manipulated to cause the swinging movement.

16. The connector according to claim 5, wherein the spring part has a cantilever form and is formed by cutting off a part of the top plate part.

17. The connector according to claim 5, further comprising:

a housing; and a terminal installed in the housing, wherein the shell covers a peripheral portion of the housing.

18. The connector according to claim 17, further comprising a cover housing, the cover housing having a top plate part which is disposed on an upper side of the top plate part of the shell.

19. The connector according to claim 18, wherein the top plate part of the cover housing has a latch opening part formed therein, the latch operating part configured to be manipulated to cause the swinging movement.

20. The connector according to claim 6, wherein the spring part has a cantilever form and is formed by cutting off a part of the top plate part.

21. The connector according to claim 6, further comprising:

a housing; and a terminal installed in the housing, wherein the shell covers a peripheral portion of the housing.

22. The connector according to claim 21, further comprising a cover housing, the cover housing having a top plate part which is disposed on an upper side of the top plate part of the shell.

23. The connector according to claim 22, wherein the top plate part of the cover housing has a latch opening part formed therein, the latch operating part configured to be manipulated to cause the swinging movement.

* * * * *